US005428196A

United States Patent [19]

Beatty, Jr. et al.

[11] Patent Number: 5,428,196

[45] Date of Patent: Jun. 27, 1995

[54] FLEXIBLE SHAFT INTERFACE FOR CIRCUIT INTERRUPTER

[75] Inventors: William E. Beatty, Jr., Beaver; Roger W. Helms, Beaver Falls; Yu W. Chou, Moon Township, all of Pa.

[73] Assignee: Eaton Corporation, Cleveland, Ohio

[21] Appl. No.: 203,900

[22] Filed: Mar. 1, 1994

[51] Int. Cl.[6] ..... H01H 3/00

[52] U.S. Cl. ..... 200/329; 200/331; 200/332

[58] Field of Search ..... 200/329, 330, 331, 332, 200/337; 335/68, 71

[56] References Cited

U.S. PATENT DOCUMENTS

| | | | |
|---|---|---|---|
| 5,270,505 | 12/1993 | Magiera | 200/331 |
| 5,272,296 | 12/1993 | Robarge et al. | 200/331 |
| 5,319,168 | 6/1994 | Hutko et al. | 200/331 |

OTHER PUBLICATIONS

Siemens Installation Instructions: Flange Mount Handle Operator, Mar. 1986, pp. 1–6, Tucker, Ga. 30084.

A Working Manual on Molded Case Circuit Breakers: Breaker Basics, Fourth Edition, Aug. 1992, pp. 118–119, Pittsburgh, Pa. 15220.

*Primary Examiner*—Lincoln Donovan

*Attorney, Agent, or Firm*—Martin J. Moran

[57] ABSTRACT

A switching mechanism interfaces a flexible shaft to a handle of a circuit interrupter which is rotatable in an arcuate path between an on position and an off position. The switching mechanism includes a handle attachment attached to the handle for rotating the handle between the on position and the off position, and a bracket pivotally mounted to the handle attachment and attached to the flexible shaft for movement thereby. The handle attachment may also extend a length of the handle. The switching mechanism may further include a baseplate for securing the flexible shaft thereto and attached to the circuit interrupter. The bracket may have a generally U-shape, two arms pivotally mounted to the handle attachment, and a base which is attached to the flexible shaft. The handle attachment may be generally U-shaped and have a base and two arms which each are pivotally mounted to one of the two arms of the bracket. The two arms of the bracket may be generally oriented at right angles to the two arms of the handle attachment. The flexible shaft may have a linearly movable rod which moves generally tangential to the arcuate path of the handle and in a plane thereof. The handle attachment may have a clamp for clamping the handle attachment to the handle. The base may include a tab for positioning a length of the handle within the handle attachment. Alternatively, the handle attachment may have a base which is screwed to a hole in the handle.

13 Claims, 5 Drawing Sheets

FLEXIBLE SHAFT INTERFACE FOR CIRCUIT INTERRUPTER

BACKGROUND OF THE INVENTION

1. Field of the Invention

This invention is directed to an interface between a flexible shaft and a circuit interrupting device, and more particularly to such an interface between a linearly movable rod of the flexible shaft and a handle of a circuit breaker.

2. Background of Information

Circuit interrupters (e.g., circuit switching devices, circuit breakers, etc.) are generally old and well-known in the art. Examples of circuit breakers are disclosed in U.S. Pat. Nos. 4,489,295; 4,638,277; 4,656,444 and 4,679,018. Such circuit breakers are used to protect electrical circuitry from damage due to an overcurrent condition, such as an overload and relatively high level short circuit condition. Molded case circuit breakers include at least one pair of separable contacts which may be operated either manually by way of a handle disposed on the outside of the case or automatically in response to an overcurrent condition. A common type of circuit switching device has a front face with a manual handle which may be arcuately operated between an on position and an off position. A common type of circuit breaker has a similar handle which is connected to movable contacts through a spring powered, over center toggle device which trips the contacts open and moves the handle to an intermediate trip position in response to certain overcurrent conditions. A fourth, reset position, which is beyond the off position and opposite from the on position, is used to reset a trip mechanism of the circuit breaker following a trip condition.

For a variety of reasons, such as operator safety, circuit interrupters are commonly mounted behind a panel or behind a door in a cabinet. Typically in these installations, the handles of the circuit interrupters are not directly accessible by the operator. In some of these installations, a remote handle mechanism is mounted to the opposite side of the panel or door and a mechanical linkage is used to interconnect the remote handle mechanism with the circuit interrupter handle.

In other installations, a flexible shaft replaces the mechanical linkage. The flexible shaft includes a fixed outer jacket having a linearly movable core; a bulkhead hub for securing the fixed outer jacket on one side of the bulkhead and for providing a swivel sleeve on the other side; and a linearly movable rod, which exits an end of the sleeve opposite from the bulkhead and which is attached to the movable core within the sleeve. In such other installations, the remote handle mechanism drives one end of the core of the flexible shaft in a linear push-pull manner. The rod at the other end of the flexible shaft is used to drive a sliding operating mechanism in a similar linear push-pull fashion. The sliding operating mechanism is mounted on the front face of the circuit interrupter and has a hole for inserting the circuit interrupter handle therethrough. In turn, the linear motion of the sliding operating mechanism is used to simulate the arcuate motion of the circuit interrupter handle.

Operability of the remote handle mechanism with the flexible shaft and the sliding operating mechanism is limited in several ways. First, friction between the sliding operating mechanism and the circuit interrupter handle increases the operating forces required to drive the flexible shaft. Second, the force applied by the sliding operating mechanism to the circuit interrupter handle is generally angled away from a tangent to the arcuate rotation path of the handle. Thus, only a fraction of the force provided by the flexible shaft is applied to rotate the handle. Finally, because the hole of the sliding operating mechanism generally drives the handle at a point below an end of the handle, only a fraction of the available handle leverage is utilized. Therefore, an additional force, beyond the operating force at the handle end, is required.

There is a need, therefore, for a flexible shaft interface for a circuit interrupter handle that significantly improves operability and reduces the operating force required to drive the flexible shaft.

There is a more particular need for such an interface that reduces friction between the interface and the handle.

There is another more particular need for such an interface that increases leverage between the interface and the handle.

There is an additional need for a flexible shaft interface for a circuit interrupter handle that significantly reduces the operating force required to drive the flexible shaft.

There is yet another need for a flexible shaft interface for a circuit interrupter handle that cooperates with the handle without requiring a modification of the handle.

SUMMARY OF THE INVENTION

These and other needs are satisfied by the invention which is directed to an interface between a flexible shaft and a handle of a circuit interrupter. The handle is rotatable in an arcuate path between an on position and an off position. In accordance with the invention, a handle extension having a base and two arms is attached to the handle for extending a length of the handle and for rotating the handle between the on position and the off position. A generally U-shaped bracket having a base and two arms is pivotally mounted by the arms of the bracket to the arms of the handle extension. The base of the U-shaped bracket is attached to a linearly movable end of the flexible shaft. A bulkhead hub of the flexible shaft is fixedly mounted to a face of the circuit interrupter by a mounting bracket. A pulling motion of the flexible shaft pulls the bracket which rotates the pivotally mounted handle extension and the attached handle toward the off position. Similarly, a pushing motion of the flexible shaft pushes the bracket which rotates the handle extension and the handle toward the on position.

Either a pulling or a pushing force, applied by the flexible shaft to the bracket, is generally in the same linear direction as a longitudinal axis of the arms of the bracket. Thus, the entire force of the flexible shaft is generally applied to the bracket. Furthermore, the longitudinal axis of the arms of the pivotally mounted bracket, and hence the force applied to the bracket, is generally tangential to the arcuate path of the handle between the on and the off positions. Therefore, the entire force of the flexible shaft and the bracket is generally applied to efficiently rotate the handle. Moreover, because the pivot point of the arms of the bracket and the arms of the handle extension is extended beyond an end of the handle, the additional leverage associated with the extended length reduces the force required to move the handle between the on and the off positions.

In one embodiment of the invention, the base of the handle extension has a mounting tab which rests on an end of the handle. In this manner, the handle extension is self-positioned on the handle. The base further has a mounting clamp, which is secured to the base, at either end of the clamp, by mounting hardware. Thus, the base, mounting tab and clamp firmly grasp the handle without requiring any modification of the handle (e.g., drilling a mounting hole).

In an alternative embodiment of the invention, for circuit interrupters having a handle with a mounting hole, an alternative handle extension is provided. This alternative handle extension is similar in operation to the above described handle extension. However, the alternative handle extension does not have a handle mounting clamp or a handle mounting tab. Instead, the handle is secured by mounting hardware to a mounting hole in a base of the alternative handle extension. Furthermore, a cross-pin, located between the arms of the alternative handle extension, relieves stress on the handle and the handle mounting hardware whenever the flexible shaft applies a pulling force.

It is an object of the invention to provide a flexible shaft interface for a circuit interrupter handle that conserves a driving force of a linearly movable core of the flexible shaft by substantially pulling or pushing along a longitudinal axis of the shaft.

It is a more particular object of the invention to provide such an interface that minimally rotates a swivel sleeve of the flexible shaft in order to substantially pull or push along the longitudinal axis of the shaft.

It is another object of the invention to provide a flexible shaft interface for a circuit interrupter handle that applies a linear pulling or pushing force substantially tangential to an arcuate rotation path of the handle.

It is yet another object of the invention to provide a flexible shaft interface for a circuit interrupter handle that cooperates with the handle without requiring a modification of the handle.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
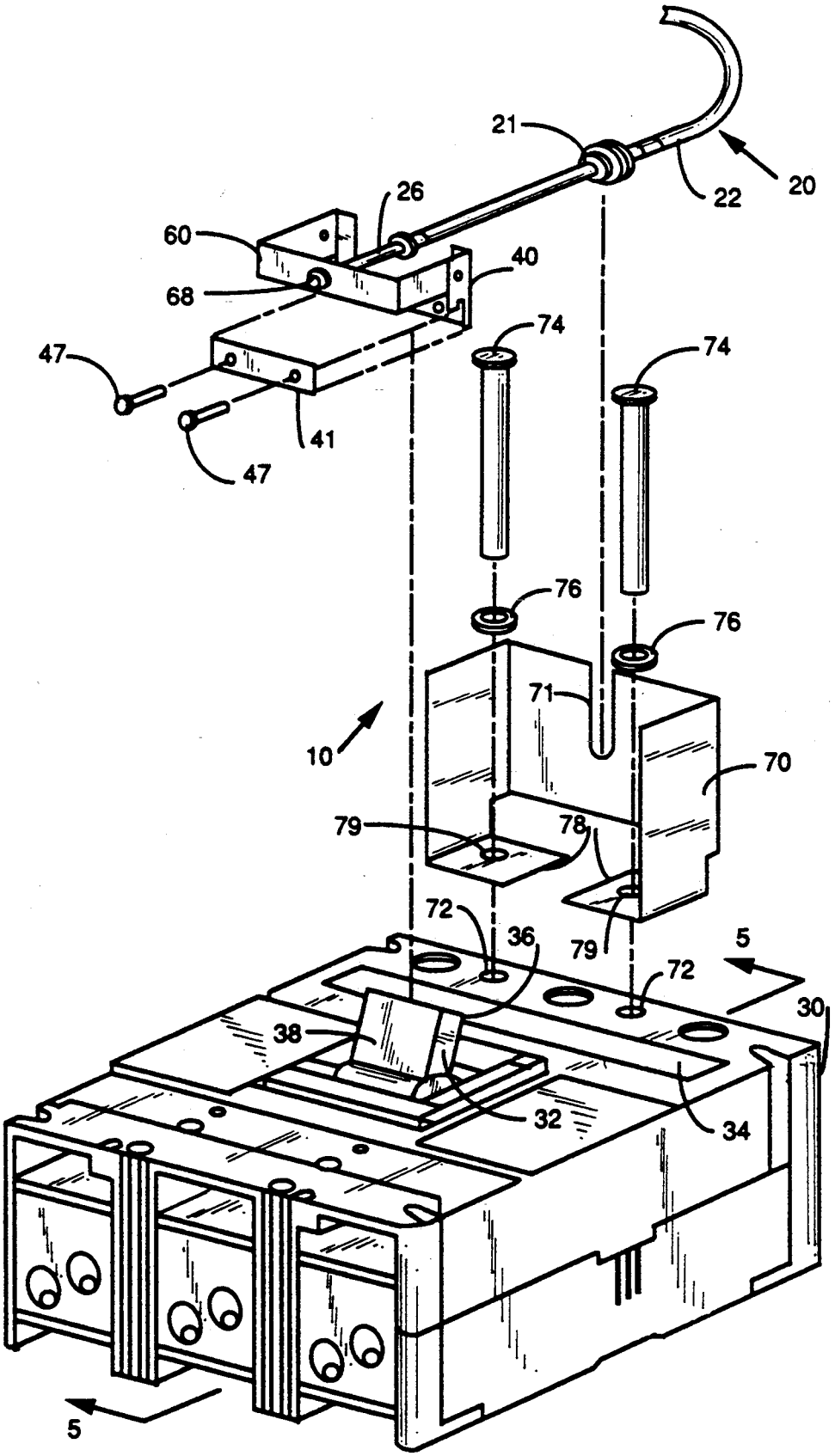
FIG. 1 is an exploded perspective view of a flexible shaft interface attached to a handle of a circuit interrupter in accordance with an embodiment of the invention.
Figure 2:
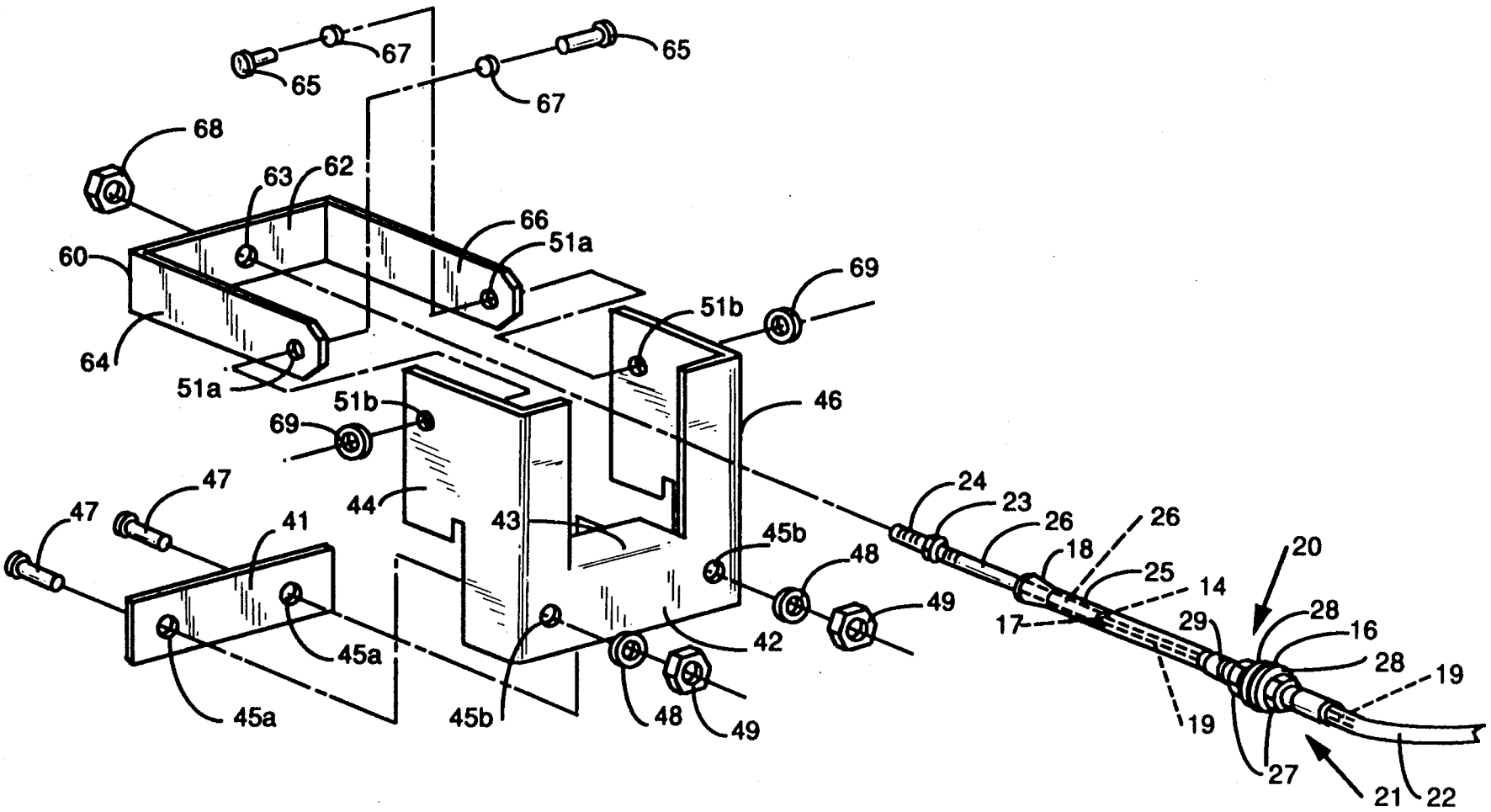
FIG. 2 is an exploded perspective view of the flexible shaft interface in accordance with the embodiment of FIG. 1.
Figure 3:
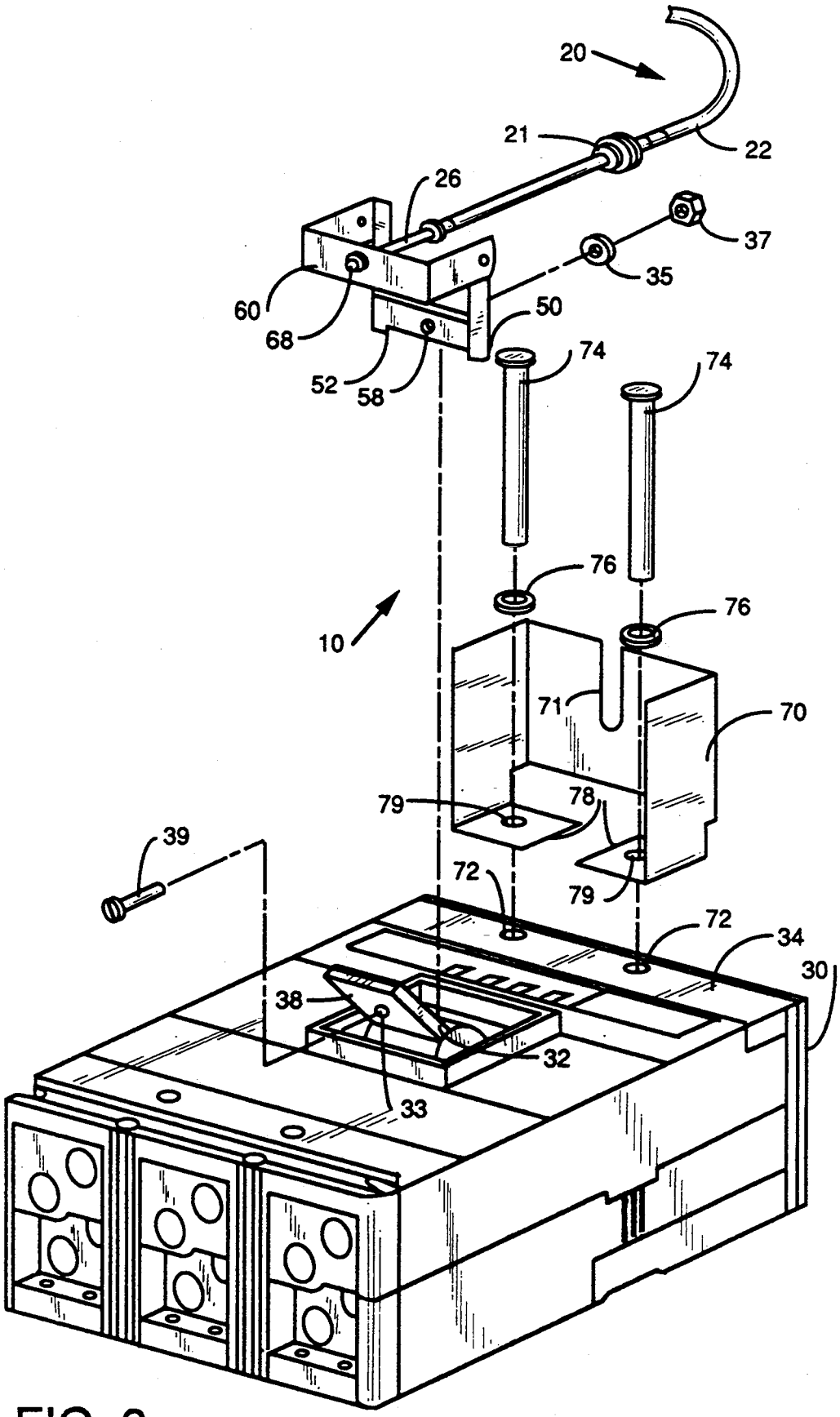
FIG. 3 is an exploded perspective view of a flexible shaft interface attached to a handle of a circuit interrupter in accordance with an alternative embodiment of the invention.

Referring to FIGS. 1–2, a switching mechanism 10 interfaces a flexible shaft 20 to a circuit breaker 30. The circuit breaker 30 has a handle 32 and a front face 34. The handle 32 is arcuately movable between an off position (as shown in FIG. 1) and an opposite on position (as shown in FIG. 3). The handle 32 has a lower surface 36 (facing away in FIG. 1) for pushing the handle 32 toward the on position and an opposite upper surface 38 for pulling the handle 32 toward the off position. It being understood that the invention is applicable to additional handle positions (e.g., trip and reset) as well as other types of circuit interrupters (e.g., a circuit switching device).

The flexible shaft 20 includes a fixed outer jacket 22 having an inner movable core 19 (shown in shadow in FIG. 2). A bulkhead hub 21 secures the fixed outer jacket 22 on one side of the hub 21 and provides a swivel sleeve 29 on the other side. The bulkhead hub 21 includes two outer hex nuts 27 and two inner washers 28 for fixedly securing the flexible shaft 20 to a baseplate 70. The swivel sleeve 29 connects a sleeve 25 to the bulkhead hub 21 in order that a longitudinal axis of the sleeve 25 may rotate approximately 8 degrees with respect to a longitudinal axis of the hub 21. The sleeve 25 also encloses the inner movable core 19 which is routed through the outer jacket 22 and the bulkhead hub 21. A linearly movable rod 26, which exits an end of the sleeve 25 at a rod seal 18, has an internal end 14 (shown in shadow in FIG. 2) which is attached to an end 17 (shown in shadow in FIG. 2) of the inner movable core 19 within the sleeve 25. A remote handle mechanism (not shown) drives the other end (not shown) of the core in a linear push-pull manner. A threaded end 24 of the rod 26 includes a hex nut 23 and is secured to a bracket mechanism 60 in a manner to be described below.

A baseplate 70 is formed in a generally inverted-U-shape and has an upper U-shaped mounting depression 71 and two lower feet 78 which each have a mounting hole 79. The baseplate 70 is attached to two mounting holes 72 in the face 34 of the circuit breaker 30 using two screws 74 and two lock washers 76. The flexible shaft 20 rests within the depression 71 at a center 16 of the hub 21. The baseplate 70 is secured to the hub 21 between the washers 28 by the hex nuts 27.

A generally U-shaped handle extension 40 having a base 42 and two L-shaped arms 44,46 is attached to the handle 32. The extension 40 extends a length of the handle 32 and is utilized to rotate the handle 32 between the on position and the off position. A mounting tab 43, which is perpendicular to the base 42, rests on top of the handle 32. This positions a length of the handle 32 within the base 42 and allows the handle extension 40 to be self-positioned on the handle 32. The base 42 faces the lower surface 36 of the handle 32. A rectangular clamp 41 having two holes **45*a* on either end is attached to the base 42 at corresponding holes 45*b* using screws 47, lock washers 48 and hex nuts 49. In the exemplary embodiment, the clamp 41 and the base 42 firmly grasp the handle 32 without requiting a handle mounting hole 33** (see FIG. 3).

A bracket 60 is generally U-shaped and includes a base 62 and two arms 64,66 which each have pivot holes **51*a*. The bracket 60 is pivotally mounted at the pivot holes 51*a* of the arms 64,66 to corresponding pivot holes 51*b* in the arms 44,46, respectively, using rivets 65, hardened sleeves 67 and washers 69. The threaded end 24 of the rod 26 is passed through a hole 63 in the base 62 and is connected to the base 62 using opposing hex nuts 23,68. Those skilled in the art will appreciate that the hex nuts 23,68 are adjusted to properly position the rod 26, in order to accurately translate linear positions of the rod 26 to the corresponding on and off positions of the handle 32**.

A pulling motion of the rod 26 pulls the bracket 60 which rotates the handle extension 40 and the handle 32 toward the off position. On the other hand, a pushing motion of the rod 26 pushes the bracket 60 which rotates the handle extension 40 and the handle 32 in the opposite direction toward the on position.

Figure 5:
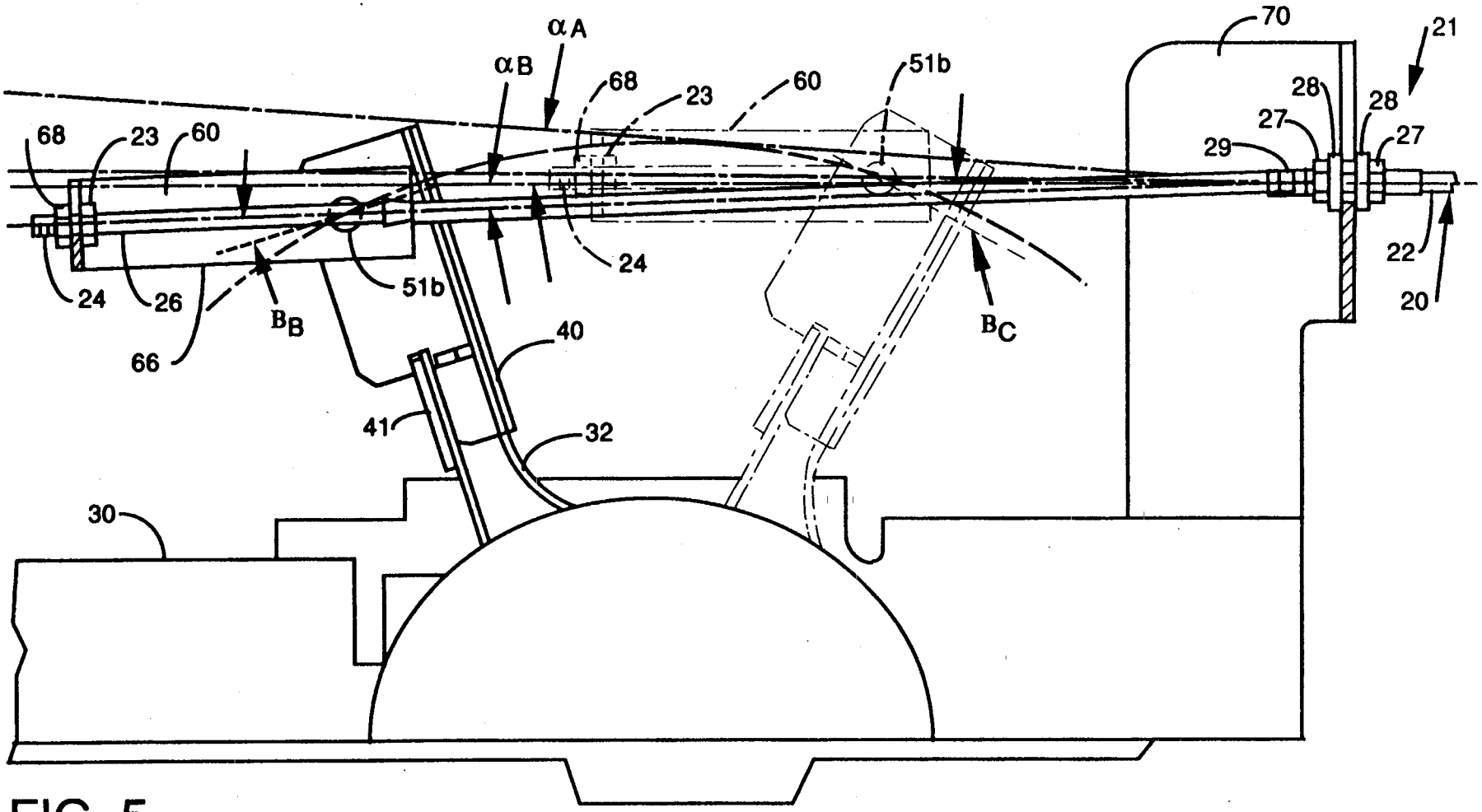
FIG. 5 is a vertical cross-sectional view of a circuit interrupter having a handle driven by a flexible shaft interface and a flexible shaft along line 5—5 of FIG. 1.

As shown in FIG. 5, either a pulling or pushing force, applied by the rod 26 to the bracket 60, is generally in the same linear direction as a longitudinal axis of the arms 64 (see FIG. 2) and 66 of the bracket 60. An angle of a longitudinal axis of the rod 26 with respect to a longitudinal axis of the bulkhead hub 21 of the flexible shaft 20 ranges between $\alpha_A$ and $\alpha_B$, which are limited to an absolute value of approximately 8 degrees in the exemplary embodiment. Thus, at least 99% (or the cosine of 8 degrees) of the pulling or pushing force of the flexible shaft 20 is applied to the bracket 60. Furthermore, an angle of a longitudinal axis of the arms 64,66 with respect to a tangent to an arcuate path of the handle 32 ranges between $\beta_B$ and $\beta_C$, which are limited to an absolute value of approximately 30 degrees in the exemplary embodiment. Thus, at least 86% (or the cosine of 30 degrees) of the pulling or pushing force of the rod 26 and the attached bracket 60 is applied to the handle extension 40. Therefore, at least 85% of the pulling or pushing force of the flexible shaft 20 is applied to the handle 32. Moreover, those skilled in the art will appreciate that because the pivot points 51*a*,51*b* (see FIG. 2) of the arms 44,46,64,66 (see FIG. 2) are extended beyond an end of the handle 32, the additional leverage reduces the requisite force to move the handle 32 between the on and the off positions.

Figure 4:
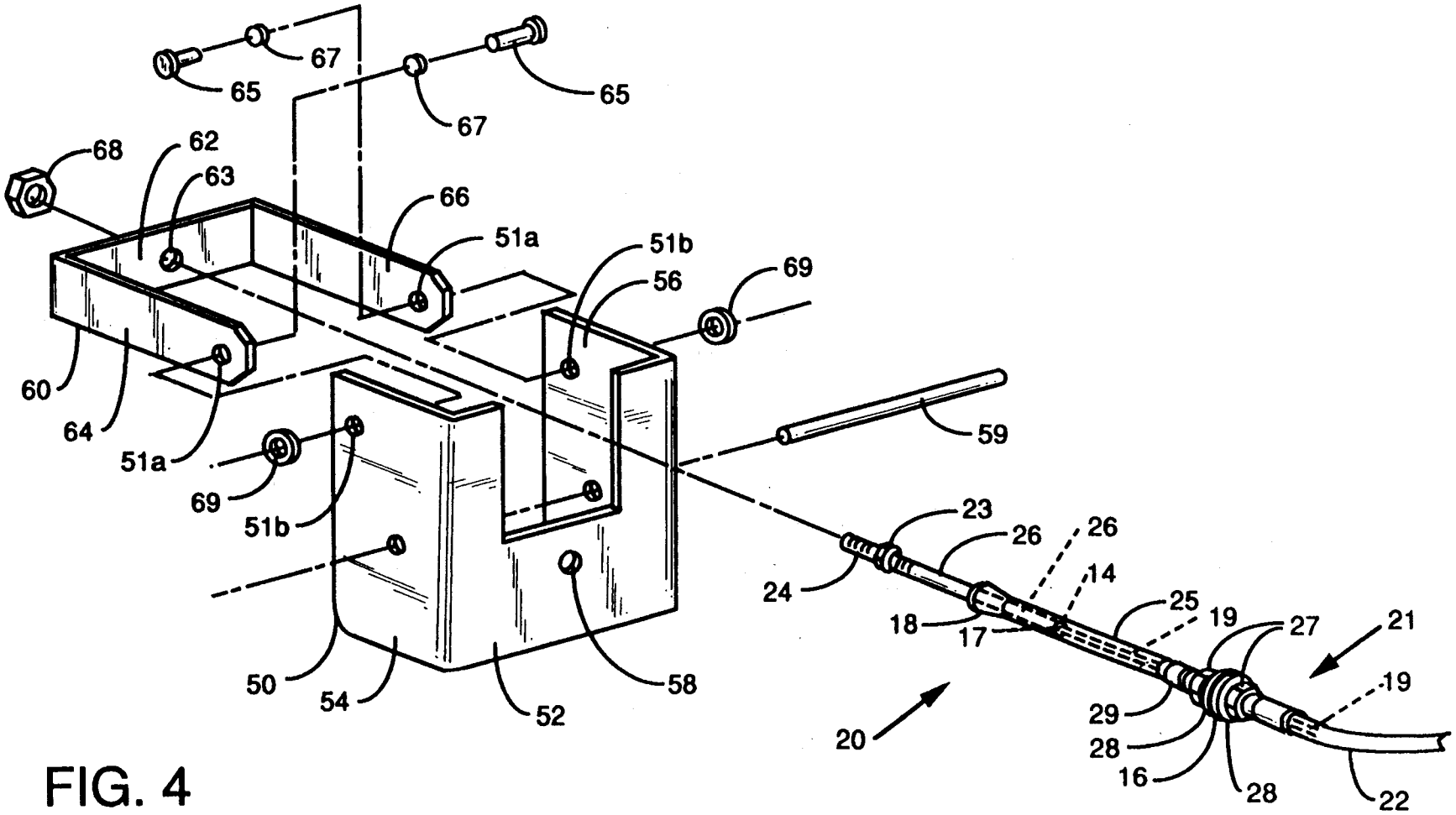
FIG. 4 is an exploded perspective view of the flexible shaft interface in accordance with the embodiment of FIG. 3.

Referring now to FIGS. 3–4, an alternative embodiment of the invention is illustrated for handle 32 having a mounting hole 33. An alternative handle extension 50 is similar in operation to the above described handle extension 40 (see FIGS. 1–2). The handle extension 50 has a base 52 and two L-shaped arms 54,56, which each have a pivot hole 51*b*. However, the handle extension 50 does not utilize a handle mounting clamp 41 or a handle mounting tab 43 (see FIGS. 1–2). Instead, the handle 32 is secured to the handle extension 50 by a screw 39, a lock washer 35 and a hex nut 37 to a mounting hole 58 in the base 52. A cross-pin 59 is attached between the arms 54,56 of the handle extension 50 adjacent the upper surface 38 of the handle 32. Whenever the handle 32 is moved from the exemplary on position to the off position, some of the associated opening force is provided by the cross-pin 59. Thus, the cross-pin 59 relieves any excessive stress of the screw 39 at mounting hole 33.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. A switching mechanism for interfacing a flexible shaft to a handle of a circuit interrupter, the handle having an end, an on position and an off position, being rotatable in a first rotational direction to an angular position corresponding to the on position, and being rotatable in a second rotational direction to an angular position corresponding to the off position, said flexible shaft being movable in a first linear direction to a linear position corresponding to the on position, and being movable in a second linear direction to a linear position corresponding to the off position, said switching mechanism for transferring the linear movement of said flexible shaft to a rotation of the handle and comprising:

handle attachment means attached to the handle for rotating the handle between the on position and the off position, said handle attachment means having a free end which extends beyond the end of the handle; and bracket means pivotally mounted to the free end of said handle attachment means and attached to said flexible shaft for movement thereby, in order that movement of said flexible shaft in the first linear direction pivots said bracket means and rotates the handle in the first rotational direction toward the on position, and in order that movement of said flexible shaft in the second linear direction pivots said bracket means and rotates the handle in the second rotational direction toward the off position.

2. The switching mechanism as recited in claim 1, said switching mechanism further comprising baseplate means for securing said flexible shaft thereto and attached to said circuit interrupter.

3. The switching mechanism as recited in claim 1, wherein said flexible shaft has an outer jacket, an inner linearly movable core, a transitional bulkhead for holding the outer jacket on a first side thereof and for passing the inner linearly movable core therethrough, a sleeve pivotally mounted to the transitional bulkhead on a second side thereof and surrounding an end of the inner linearly movable core, and a linearly movable rod having a first end connected to the end of the inner linearly movable core within the sleeve, and having a second end attached to said bracket means, said switching mechanism further comprising baseplate means for mounting the transitional bulkhead thereto and attached to said circuit interrupter.

4. The switching mechanism as recited in claim 1, wherein said handle attachment means includes clamp means for clamping said handle attachment means to the handle.

5. The switching mechanism as recited in claim 4, wherein said handle attachment means faces a first side of the handle, said clamp means faces a second side of the handle and is fastened to said handle attachment means in order to attach said handle attachment means to the handle.

6. The switching mechanism as recited in claim 5, wherein said handle attachment means has a generally U-shape, a base and two arms, the base having attachment means for fastening said clamp means.

7. The switching mechanism as recited in claim 1, wherein said handle attachment means includes screw means for screwing said handle attachment means to the handle.

8. The switching mechanism as recited in claim 7, wherein said handle attachment means has a generally U-shape, a base and two arms, the base having a hole for fastening the screw means.

9. The switching mechanism as recited in claim 1, wherein said bracket means has a generally U-shape, a base and two arms, the base attached to said flexible shaft for movement thereby, each of the two arms pivotally mounted to the free end of said handle attachment means.

10. The switching mechanism as recited in claim 9, wherein said handle attachment means has a generally U-shape having a base and two arms which extend from the base to the free end of said handle attachment means, each of the two arms of said handle attachment means being pivotally mounted to one of the two arms of said bracket means.

11. The switching mechanism as recited in claim 10, wherein the two arms of said bracket means are generally oriented at fight angles to the two arms of said handle attachment means.

12. The switching mechanism as recited in claim 6, wherein the handle of said circuit interrupter has a length, and wherein the base of said handle attachment means includes tab means for positioning at least part of the length of the handle of said circuit interrupter within said handle attachment means.

13. The switching mechanism as recited in claim 3, wherein the handle rotates in an arcuate path, and wherein the linearly movable rod moves generally tangential to the arcuate path of the handle and in a plane thereof.

* * * * *